US008250819B2

(12) United States Patent
Subra

(10) Patent No.: US 8,250,819 B2
(45) Date of Patent: Aug. 28, 2012

(54) ASSOCIATION OF TWO HOLLOW SECTION ENDS MADE OF PLASTIC USING A CONNECTOR

(75) Inventor: Renaud Subra, Duebendorf (CH)

(73) Assignee: Saint-Gobain Glass France, Courbevoie (FR)

( * ) Notice: Subject to any disclaimer, the term of this patent is extended or adjusted under 35 U.S.C. 154(b) by 340 days.

(21) Appl. No.: 12/377,352

(22) PCT Filed: Sep. 18, 2007

(86) PCT No.: PCT/FR2007/051954

§ 371 (c)(1), (2), (4) Date: Feb. 12, 2009

(87) PCT Pub. No.: WO2008/035003

PCT Pub. Date: Mar. 27, 2008

(65) Prior Publication Data

US 2010/0192508 A1 Aug. 5, 2010

(30) Foreign Application Priority Data

Sep. 20, 2006 (FR) ..... 06 53828

(51) Int. Cl.
*E06B 7/12* (2006.01)

(52) U.S. Cl. ..... 52/172; 52/656.9

(58) Field of Classification Search ..... 52/172, 52/656.9; 403/295
See application file for complete search history.

(56) References Cited

U.S. PATENT DOCUMENTS

| | | | | |
|---|---|---|---|---|
| 1,817,775 | A * | 8/1931 | Sipe | 403/361 |
| 2,989,788 | A * | 6/1961 | Kessler | 403/295 |
| 3,966,339 | A * | 6/1976 | Nemecek et al. | 403/292 |
| 4,683,634 | A * | 8/1987 | Cole | 29/412 |
| 5,099,626 | A * | 3/1992 | Seeger | 52/314 |
| 6,244,012 | B1 * | 6/2001 | McGlinchy et al. | 52/665 |

FOREIGN PATENT DOCUMENTS

| | | |
|---|---|---|
| DE | 40 02 338 | 8/1991 |
| EP | 0 283 689 | 9/1988 |
| EP | 0 852 280 A1 | 7/1998 |
| EP | 0 875 654 B1 | 11/2001 |
| EP | 1 847 675 | 10/2007 |
| FR | 2 563 270 | 10/1985 |
| FR | 2 604 210 | 3/1988 |
| FR | 2 659 108 | 9/1991 |

* cited by examiner

*Primary Examiner* — Jeanette E Chapman
*Assistant Examiner* — Daniel Kenny
(74) *Attorney, Agent, or Firm* — Oblon, Spivak, McClelland. Maier & Neustadt, L.LP.

(57) ABSTRACT

An association formed from two hollow section ends, the inside of which is based on a plastic that are butted together by a connector, the connector including a body with a central part and two flanges made of plastic that are engaged in the hollow section ends respectively and that have an anchoring mechanism capable of keeping the hollow ends in place around the connector. The anchoring mechanism of the connector is made of plastic and includes at least one element that is flexible and comes into friction contact with the inside of the hollow section ends.

20 Claims, 1 Drawing Sheet

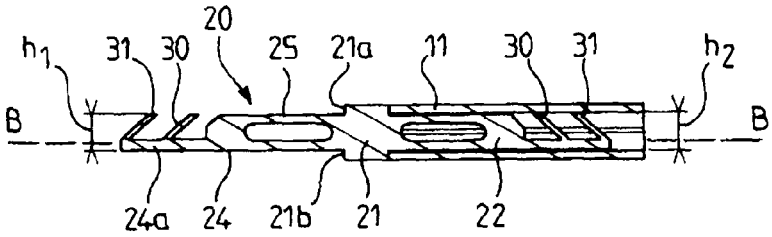
FIG.1
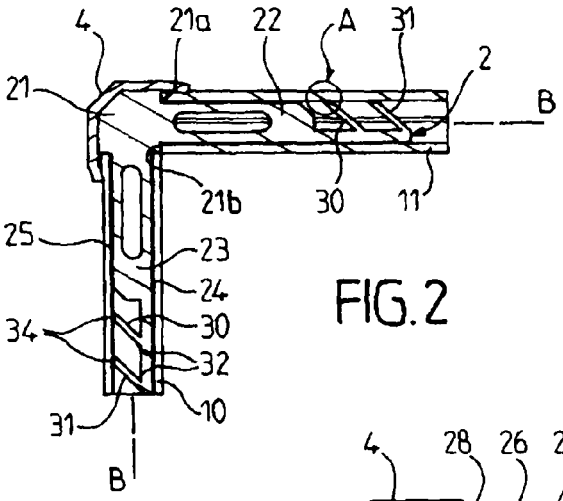
FIG.2
FIG.3
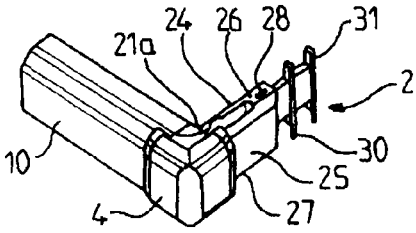
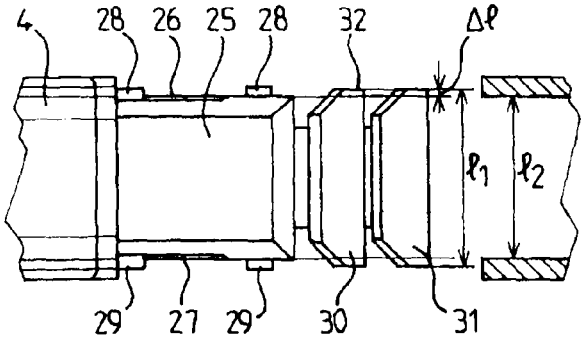
FIG.4
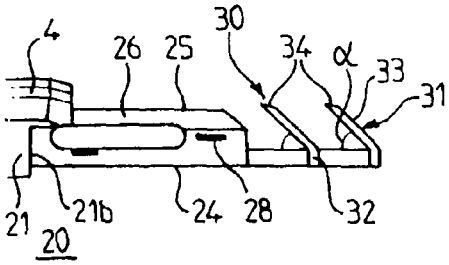
FIG.5
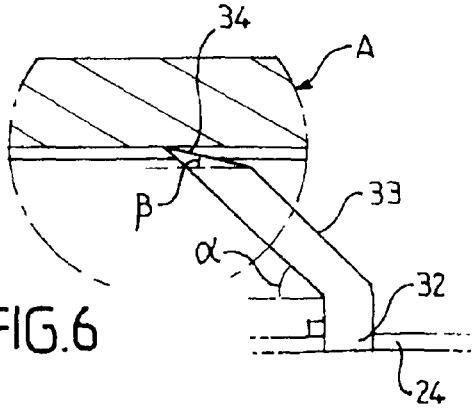
FIG.6

ASSOCIATION OF TWO HOLLOW SECTION ENDS MADE OF PLASTIC USING A CONNECTOR

TECHNICAL FIELD

The invention relates to the association of two hollow section ends using a connector inserted into said ends, the section ends being based on a plastic. Such an association is used in particular to form the insert frame of an insulating glazing unit. The expression "two hollow section ends" is understood to mean the two free ends of two separate sections respectively, or else two free ends of a single section folded back on itself.

BACKGROUND

One well-known type of insulating glazing unit comprises two sheets of glass that are separated by a gas layer, such as a layer of air, which are spaced apart and held together by means of a spacer frame consisting of folded hollow sections or of sections assembled by central and/or angle components called connectors. The 90° angle components are usually called brackets.

The sections are provided with a molecular sieve, the purpose of which is in particular to absorb the water molecules trapped in the air interlayer during manufacture of the glazing, which molecules would be liable to condense in cold weather, which would cause fogging to appear.

To ensure that the glazing is sealed, the spacer frame is bonded to the glass sheets by a bead of elastomer of the butyl rubber type applied directly to the sections forming the spacer frame by extruding it through a nozzle.

Once the glazing has been assembled, the elastomeric sealing bead has the function of providing temporary mechanical retention of the glass sheets. Finally, a crosslinkable sealing mastic, of the polysulfide or polyurethane type, is injected into the peripheral groove bounded by the two glass sheets and the spacer frame, thereby completing the mechanical assembly of the glass sheets. The purpose of the butyl rubber is mainly to seal the inside of the glazing from water vapor, whereas the mastic seals against liquid water or solvents.

The hollow sections used are generally made of metal, such as aluminum. However, for some time now plastic sections have been used, such as those described in patent application EP 0 852 280. They thus have a lower coefficient of thermal conductivity, providing better thermal insulation power for the glazing.

Moreover, the section ends are assembled, to form the frame, by metal connectors, or at least connectors based on a plastic and having fastening/retaining elements made of metal. The connector is forcibly fitted into the hollow ends of the sections and held in place thanks to lateral retaining projections.

In the case of an entirely metallic connector, the projections are for example oriented in the opposite direction to the direction in which tension would be applied in order to pull on the section ends in the case of dismantling. Such a connector is described for example in patent application EP 0 283 689. However, this type of connector has, in particular at the lateral projections, sharp corners which may run the risk of causing injuries when handling the connector.

When the connector is not exclusively made of metal, it has at least its projecting retention/fastening elements made of metal, for example in the form of a needle that projects on either side of the lateral faces of the connector. However, these metal retention elements bite into the plastic of the sections when the connector and the sections are brought into cooperation, thereby creating internal grooves that weaken the section ends.

Patent application FR 2 604 210 proposes a connector which, provided with lateral retention projections, is however made of a plastic, thereby advantageously eliminating all sharp corners and consequently eliminating any risk of an injury deriving therefrom. This connector is nevertheless easy to fit into the hollow section ends, without any risk of weakening said ends, owing to the different metallic material constituting the section ends. This is because, at the time when said document was disclosed, the existing sections were exclusively metallic.

Also, for section ends made of plastic, a solution has therefore been used for some time. This involves connectors made entirely of plastic that are oversized considerably along their entire length so as in this way to ensure retention after they have been forcibly inserted into the sections. However, this solution often causes the sections to burst, and has therefore been abandoned.

SUMMARY

The object of the invention is therefore to produce an association between two section ends that are made from a plastic, using a connector that allows easy and reliable assembly of the sections, or of the section if this is folded back on itself, while obviating any risks of injury when handling this connector and/or risks of weakening, or even destroying, the elements once they have been connected.

The invention therefore relates to an association formed from two hollow section ends based on a plastic that are butted together by means of a connector, the connector comprising a body with a central part and two flanges made of plastic that are engaged in the hollow section ends respectively and have anchoring means capable of keeping said hollow ends in place around the connector by being in friction contact with the inside of said hollow section ends, characterized in that the anchoring means of the connector are made of plastic and at least one of the anchoring means is flexible so as to deform when pressure is applied to it.

In the rest of the description, the expression "flexible anchoring means", as opposed to "rigid anchoring means", is therefore understood to mean that the anchoring means has the property of deforming when pressure is applied to it. A material suitable for the anchoring means of the invention has for example a flexural modulus of elasticity of between 3500 and 9000 MPa, this flexural modulus of elasticity being measured according to the ISO 178 and ISO 527 standards.

Advantageously, the flexible anchoring means exerts a stress opposing the tensile force that would be involved if it were desired for the connector to be fully removed from the section ends when pulling on these ends. Because of the flexibility of this anchoring means, the stress is much lower than a rigid stress on a continuous surface, which otherwise would lead to the section ends bursting.

Since the connector (body and anchoring means) are made only of plastic, this makes it possible to achieve savings in terms of material cost and manufacturing cost, owing to the simplicity of the manufacturing process, for example by simply molding the component, and consequently avoids having an additional quality control operation as would be necessary to perform when the anchoring means are for example made of metallic elements to be fastened and suitably positioned on the sides of the plastic connector.

Advantageously, the anchoring means and the body of the connector are made of the same plastic.

According to one feature, the cross-section of the connector in question along its shortest extension, and at the flexible anchoring means, is oversized relative to the internal dimensions of the section ends.

Preferably, the connector includes at least one flexible anchoring means on each flange.

According to one feature, the anchoring means also comprise rigid studs projecting on either side of two opposed sides of each of the flanges. These rigid anchoring means provide a point stress on the internal walls of the section ends, which is therefore localized at only certain points, thereby preventing any inopportune removal of the connector out of the section ends, without risk of the ends bursting. The studs also have the advantage of positioning the connector by centering it in the section ends. This ensures perfectly parallel abutment of the ends.

According to another feature, the flexible anchoring means is integral with a prolongation of a flange, the prolongation being along its two extensions of shortest length and smallest size that the flange associates, and the anchoring means projecting from said prolongation.

Apart from the constituent material of the flexible anchoring means, which is suitable for providing the elasticity property, such as a polyamide, polypropylene or SAN, preferably filled with reinforcing fibers, the smallest size in terms of thickness and in terms of width of the prolongation of the flange relative to the flange itself makes it possible to hollow out the material around the flexible anchoring means, which then have bending and elasticity liberty longitudinally and laterally, the prolongation serving merely to support the base of the flexible anchoring means.

According to another feature, each flange of the connector has two opposed longitudinal faces and two opposed lateral faces extending along the longest extension of the flange and connecting together the two longitudinal faces respectively, at least one flexible anchoring means of each flange, on at least one of its sides, projecting with respect to a plane containing one of the lateral faces of a flange.

The flexible anchoring means takes the form of a lip and advantageously comprises a base, which is integral with the prolongation of the flange, an extension that extends so as to project from the prolongation and is inclined toward the central part of the connector, and also a free end that is in contact with the internal walls of the section ends. The term "lip" is intended to mean an element that projects from that part of a body supporting it and has a small thickness, much less than the thickness of said part of the body. In one application, the thickness is around 0.5 mm.

Moreover, the height $h_1$, which corresponds to the largest height of the cross-section of the connector, along the shortest extension of the cross-section, is established at at least one flexible anchoring means and is larger than the internal height $h_2$ of a section end. Advantageously, the dimensional height variation $\Delta h$ between $h_1$ and $h_2$ does not exceed 0.5 mm.

In addition, the width $\ell_1$ which corresponds to the largest width of the cross-section of the connector, along the shortest extension of the cross-section, is also established at at least one flexible anchoring means, and is larger than the internal width of the hollow section ends.

The dimensional width variation $\Delta\ell$ between the two widths $\ell_1$ and $\ell_2$ at at least one side of a wall of a section end is at most 0.5 mm. In the example of the invention illustrated, the width of the flexible anchoring means is larger than the internal width of a section end by having a dimensional variation on two opposed sides of the inside of the section end, equally and symmetrically with respect to the longitudinal axis of the flange.

This oversizing of the at least one flexible anchoring means in terms of width and height relative to the internal dimensions of the section ends makes it possible to exert stresses that oppose the tensile forces that would have to be established if it were desired to remove the connector. Owing to the elasticity of the flexible anchoring means, these stresses remain below values that would otherwise result in the section ends bursting.

Advantageously, the flexible anchoring means has a thickness e and a length L such that the ratio $e/L<1/3$ and preferably $e/L<1/4$, thereby making it possible to further reduce the stresses against the walls of the section ends when the connector is in place.

Preferably, at least one flexible anchoring means has its free end, which is beveled, in the opposite direction to the central part of the connector. In this way, it is even more difficult to remove the connector from the section ends once it is in place.

According to another feature, the central part of the connector includes lateral protuberances that act as stops at the two section ends, which are engaged around the two flanges respectively. When it is necessary depending on the application, to ensure that the association is sealed, the central part includes sealing means that cover the region where the section ends abut against said central part.

This association between a connector, which may be an angle connector or a straight connector, and two section ends is therefore in particular used to form a frame, especially a frame for constituting the insert of an insulating glazing unit.

BRIEF DESCRIPTION OF THE DRAWINGS

Other advantages and features of the invention will now be described in greater detail in conjunction with the appended drawings in which:

FIG. 1 is a cross-sectional view of a connector for a straight joint according to the invention, one side of which is associated with a section end;

FIG. 2 is a cross-sectional view of the association of two section ends with a connector forming an angle joint according to the invention;

FIG. 3 is an end view of the connector of the invention intended for an angle joint, such as that shown in FIG. 2, one part of the connector being joined to the hollow end of a section;

FIG. 4 is a partial top view of one end of a connector before it is inserted into a hollow section end;

FIG. 5 is a partial elevation view of one end of a connector; and

FIG. 6 is a side view of a lip of the connector, part of which is a cross-sectional view and corresponds to the enlarged view of part A in FIG. 2.

DETAILED DESCRIPTION

FIGS. 1 and 2 illustrate the association, or partial association, of two hollow ends 10 and 11 of sections that are joined together by butting them together using a connector 2.

The section ends are made of plastic, such as a thermoplastic of the SAN type, reinforced by glass fibers, and are provided in particular on one of their faces with a thin metal coating. The abutment of these two ends serves in particular to constitute a spacer frame intended for the manufacture of an insulating glazing unit. For greater detail concerning the nature of the sections forming this frame, the reader may refer to European patent application EP 0 852 280.

The frame may be formed from a single section folded in the corners, as described in the bending process disclosed in patent EP 0 875 654-B1. The two free ends of the section can then be joined together by an oblong connector of the invention in the manner illustrated in FIG. 1 as a straight joint.

When the frame consists of a plurality of sections cut to the length of each side of the glazing, the two ends of two respective adjacent sections are joined together by an angle connector of the invention in the manner illustrated in FIG. 2 as an angle joint of the 90° (bracket) type.

With reference to FIGS. 1 to 3, the oblong connector and the angle connector have in common a body 20 which comprises a central part 21 and two flanges 22 and 23 extending on either side of the central part along a longitudinal axis B. The two flanges are oriented in the same direction in the case of the oblong connector and along two different directions angularly in the case of the angle connector.

For such an application, the length of the straight connector from the end of one flange to the end of the other flange along the longitudinal axes B is for example about 50 mm: the cross-section of the connector, along its shortest extension in a plane perpendicular to the axes B, has a height of around 3 to 10 mm and a width of 6 to 30 mm.

Moreover, to manufacture an insulating glazing frame, it is necessary to seal this association. Sealing means 4 are then provided, these being placed on the central part 21 and covering the abutment regions (FIG. 2).

The body 20 of the connector according to the invention is made of a plastic, such as a plastic possibly filled with reinforcing fibers, for example glass fibers, preferably obtained by injection molding. As examples of plastics, mention may be made of polyamide, polyethylene, SAN and polypropylene.

The flanges 22 and 23 are of substantially parallelepipedal shape. They each have two opposed longitudinal faces 24 and 25 and two opposed lateral walls 26 and 27 extending along the longest extension of a flange and joining the longitudinal faces 24 and 25.

The lateral walls 26 and 27 include studs 28 and 29 (FIG. 3) which are intended to cooperate with the internal walls of the section ends in order to constitute rigid anchoring means of the connector in the hollow ends, thus keeping the section ends firmly engaged. The rigid studs also center the connector inside the section ends, thus making it possible for the two section ends to face each other in a parallel fashion.

Each of the flanges 22, 23 also includes, at its free end, at least one, and preferably two, parallel spaced-apart flexible lips 30 and 31 which constitute additional anchoring means for the connector engaged in the section ends.

These flexible anchoring means exhibit, for the function that they have to fulfill, flexibility or elasticity, which is obtained, on the one hand, thanks to the very material of which they are made and their shape, and, on the other hand, because they do not have, around them, material in excess of the minimum material needed for fastening them to the flanges of the connector.

The flexible lips are based on a substantially elastic plastic, such as a polyamide, polypropylene or SAN, preferably filled with about 30% of glass reinforcing fibers. Advantageously, they are made of the same material as the other rigid anchoring means (studs) and as the body of the connector so as to manufacture the entire connector in a single operation, for example by molding.

Moreover, to make it easier for the connector to be fitted into the sections, the roughness of the plastic of the lips is adapted to the plastic forming the inside of the hollow sections.

Each lip has a base 32, an extension 33 and an upper end 34.

The base 32 is anchored into a prolongation 24*a* of the parallelepipedal body of the flange. One of the faces of the prolongation lies in the continuity of one of the longitudinal faces, here 24, of the flange.

In the example described here, the lips project only from one face of the prolongation 24*a*, the end 34 of the lips cooperating with the inside of the hollow section ends, whereas, oppositely, the opposed longitudinal face 24 of a flange receives, by application, the internal wall of the hollow section ends. The face 24 thus provides the connector with stability in the section ends.

The prolongation 24*a* simply provides the lips on the flanges of the connector with mechanical strength, the lips extending here from the prolongation in two directions perpendicular to the longitudinal axes B. Also, the prolongation has a much smaller thickness than the thickness of the body of the flange. The thickness is reduced to more than one half of the height of the lateral faces 26 and 27 of the flange. The width of the prolongation is also less than the width of a flange that separates the two opposed lateral faces 26 and 27.

The extension 33 of a lip starts at its base 32, which is preferably perpendicular to the web of the prolongation 24*a* of the flange (FIG. 6). The lip then extends, being inclined to the central part 21 of the connector at an angle $\alpha$ to the web of between 45 and 90° (FIGS. 5 and 6). It terminates in its upper end 34.

The width of the lips, at least near their base 32, corresponds to the largest width $\ell_1$ of the cross-section of the connector. According to the invention, this width is substantially greater than the internal width $\ell_2$ of the hollow section end so that the connector is necessarily forcibly inserted into the hollow end and, once in place exerts a stress on the internal walls of the section end that is just needed to ensure that the section end is mechanically retained around the connector. The lateral dimensional variation $\Delta\ell$ between the two widths $\ell_1$ and $\ell_2$, which may be on one side or on both sides of a lip, does not exceed 0.5 mm (FIG. 4).

Furthermore, the largest height $h_1$ of the cross-section of the connector also is at the lips. The upper end 34 of a lip also terminates substantially as a projection relative to the longitudinal face 25 of the flange that is on the opposite side from the face 24 on which the base of the lip bears. The height $h_1$ is, according to the invention, larger than the internal height $h_2$ of the hollow section end. The dimensional height variation $\Delta h$ between $h_1$ and $h_2$ does not exceed 0.5 mm (FIG. 1).

The oversizing of the connector at the lips, with a height $\Delta h$ and a width $\Delta\ell$ relative to the internal walls of the hollow section ends (not more than 0.5 mm in the case of the usual dimensions of a connector in the application of an insulating glazing frame) is advantageously designed so as not to exert too large a stress. This oversizing prevents complete removal of the connector if it were to be pulled up. Inopportune removal of the connector in the mounted position is itself prevented by a higher stress, but one that does not risk causing the section ends to burst, since this stress is highly localized (point stress) and obtained by the rigid studs 28 and 29.

The flexible lips 30 and 31 thus constitute a retention system projecting from the faces of the flanges of the connector, so as to keep the connector blocked once it has been engaged in the hollow section ends. They prevent entire removal of the connector out of the section ends. This is because, owing to the elasticity and the inclination of the lips, the latter deform more in the opposite direction to the direction of pulling required if it were desired to pull on the section ends.

The inclination at the angle α of the extension 33 is necessary in order to oppose the tensile force on the connector if the section ends were to be removed. Furthermore, it is preferred to give the extension a perpendicular profile before the inclination, as described above with regard to FIG. 6, so as to make it easier to engage the connector in the section ends.

We should add that the upper end 34 of the lips is preferably beveled, with an angle of inclination β to the base 32 in the opposite direction to the central part 21 of the connector. This inclination is thus in the opposite direction to the pulling direction that would be imposed if the connector were to be removed from the hollow end, thus further preventing removal of the connector.

Finally, the extension 33 of a lip preferably has a thickness e and length L such that the ratio e/L<1/3, in particular e/L<1/4. The thickness e is for example 0.5 mm. The length L corresponds to the dimensional magnitude starting from the base 32 as far as the free end 34. By optimizing this dimensional ratio e/L it is possible to further reduce the stresses against the walls of the section ends when the connector is in place. The length L like the width of the lip, depends on the application—here they are dependent on the internal dimensions of the hollow section ends. The length L may for example be around 5 mm and the width may be around 13 mm.

As mentioned above, the central part 11 of the body of the connector is that intended to support the sealing means 4 (FIG. 2) when the two hollow ends are butted together and when the application requires sealing. These means seal said central part of the connector and the interstices that nevertheless exist after the section ends have been butted together against the central part.

The central part 21 includes lateral protuberances that constitute projections with respect to the lateral faces 25 and 26 of the flanges so as to provide stops (references 21*a* and 21*b* respectively) for each of the sides of a hollow end when the connector is fully inserted into this end.

The sealing means 4 consist of a sealing mastic applied by injection on the central part of the connector and in the abutment interstices between the section ends and the stops 21*a* and 21*b*.

In a preferred embodiment, the invention provides for the sealing means 4 to consist of a structured element, such as a cap, made of a suitable impermeable material, this cap being molded so as to correspond to the shape needed to intimately cover the central part 21 and to partially cover the starting portion of the flanges 22 and 23 in order to cover the abutment interstices when the section ends are in place on the connector. This cap may either be attached by a fastening means of the bonding type, on the central part or may be molded directly on the central part. Such a cap is described in patent application FR 06/51370.

The invention claimed is:

1. A connection apparatus, comprising:

a connector including a central body part, two flanges extending from the central body part, and anchoring means disposed on each flange, the anchoring means including at least one element that is flexible so as to deform when pressure is applied thereto; and two hollow section ends that are adjoined via the connector, each of the two flanges being engaged in the two hollow section ends, respectively, such that, in each hollow section end, a longitudinal face of the flange therein contacts an inside wall of the hollow section, and the at least one element of the anchoring means maintains the hollow section ends around the connector via friction contact with more than one inside wall of the hollow section ends, wherein materials of the central body part, the anchoring means, and the two hollow section ends, respectively, include at least plastic.

2. The connection apparatus as claimed in claim 1, wherein the at least one element of the anchoring means exerts a stress opposing a tensile force that occurs when the hollow section end, in which the at least one element of the anchoring means is engaged, is pulled.

3. The connection apparatus as claimed in claim 1, wherein when the connector is not inserted into the hollow section ends, peripheral dimensions of the connector at a cross-section of the connector are larger than corresponding internal dimensions of the hollow section ends, such that due to the flexibility of the at least one element, the connector is accommodated forcibly in the hollow section ends upon insertion, wherein the cross-section of the connector is taken perpendicular to a longitudinal direction of the flange and at the at least one element of the anchoring means.

4. The connection apparatus as claimed in claim 1, wherein the plastic in the materials of the anchoring means and the central body part of the connector is the same plastic.

5. The connection apparatus as claimed in claim 1, wherein the anchoring means includes rigid studs that project on each of two opposed sides of each of the flanges and exert a point stress on an inside of the hollow section ends.

6. The connection apparatus as claimed in claim 1, wherein each flange includes a first portion, and a prolongation extending longitudinally from the first portion, and wherein the at least one element of the anchoring means on each flange is integral with the prolongation and projects from the prolongation.

7. The connection apparatus as claimed in claim 1, wherein each flange includes two opposed longitudinal faces, and two opposed lateral faces that adjoin the two longitudinal faces, respectively, and wherein the at least one element of the anchoring means on each flange projects therefrom with respect to a plane corresponding to one of the lateral faces of each flange, respectively.

8. The connection apparatus as claimed in claim 6, wherein the at least one element of the anchoring means is a lip including a base, which is integral with the prolongation, an extension that extends so as to project from the prolongation and is inclined toward the central body part of the connector, and a free end that is in contact with internal walls of the hollow section end with which the lip is engaged.

9. The connection apparatus as claimed in claim 1, wherein a largest height $h_1$ of the connector at a cross-section of the connector is at the at least one element of the anchoring means and is larger than an internal height $h_2$ of a hollow section end, the cross-section of the connector being taken perpendicular to a longitudinal direction of the flange.

10. The connection apparatus as claimed in claim 9, wherein a dimensional height variation Δh between $h_1$ and $h_2$ does not exceed 0.5 mm.

11. The connection apparatus as claimed in claim 1, wherein a width ℓ1, which corresponds to a largest width of a cross-section of the connector is at the at least one element of the anchoring means, and is larger than an internal width ℓ2 of the hollow section ends, the cross-section of the connector being taken perpendicular to a longitudinal direction of the flange.

12. The connection apparatus as claimed in claim 11, wherein a dimensional width variation Δℓ between ℓ land ℓ2at at least one side of a wall of a hollow section end is at most 0.5 mm.

13. The connection apparatus as claimed in claim 1, wherein the at least one element of the anchoring means has a thickness e and a length L such that e/L <1/3 or e/L <1/4.

14. The connection apparatus as claimed in claim 1, wherein the at least one element of the anchoring means includes a free end, which is beveled, an inclination of the free end being in a direction toward the central body part of the connector.

15. The connection apparatus as claimed in claim 1, wherein the central body part of the connector includes one or more lateral protuberances that abut the two hollow section ends, which are engaged around the two flanges, respectively.

16. The connection apparatus as claimed in claim 1, further comprising sealing means that cover a region of the central body part between where the hollow section ends abut against the central body part.

17. The connection apparatus as claimed in claim 1, wherein the anchoring means of the connector includes polyamide, polypropylene, or SAN, and/or is filled with reinforcing fibers.

18. The connection apparatus as claimed in claim 1, wherein the connector is an angle connector or a straight connector.

19. A frame comprising at least one connection apparatus as claimed in claim 1.

20. The connection apparatus as claimed in claim 1, wherein the at least one element of the anchoring means maintains the hollow section ends around the connector via friction contact with at least three adjacent inside walls of the hollow section ends.

* * * * *